United States Patent [19]

Hertz et al.

[11] 4,229,632

[45] Oct. 21, 1980

[54] COMPRESS GAS CIRCUIT BREAKER

[75] Inventors: Walter Hertz; Jan Stroh, both of Erlangen; Heinz Schwalme, Markt Erlbach, all of Fed. Rep. of Germany

[73] Assignee: Siemens Aktiengesellschaft, Munich, Fed. Rep. of Germany

[21] Appl. No.: 925,795

[22] Filed: Jul. 18, 1978

[30] Foreign Application Priority Data

Jul. 25, 1977 [DE] Fed. Rep. of Germany ..... 2733551

[51] Int. Cl.[3] ..... H01H 33/70

[52] U.S. Cl. ..... 200/148 A; 200/148 F

[58] Field of Search ..... 200/148 R, 148 A, 148 B, 200/148 C, 148 D, 148 E, 148 F, 148 G, 148 H, 148 J, 148 BV, 144 R

[56] References Cited

U.S. PATENT DOCUMENTS

| | | | |
|---|---|---|---|
| 2,551,772 | 5/1951 | Thibaudat | 200/148 A |
| 3,745,283 | 7/1973 | Bischofberger et al. | 200/148 R |

OTHER PUBLICATIONS

Offenlegungsschrift, 2,336,684, 7/19/73.

*Primary Examiner*—J. V. Truhe
*Assistant Examiner*—Morris Ginsburg
*Attorney, Agent, or Firm*—Kenyon & Kenyon

[57] ABSTRACT

A compressed gas circuit breaker, especially a blasting piston ("puffer") circuit breaker having a movable nozzle of insulating material which surrounds the quenching gap and, by means of pressure springs, forms a stop for closing off the gas flow canal, in which a guide is provided coupling at least one pressure spring to the relative motion of the contacts in such a manner that its effect on the insulating material body is cancelled as soon as the minimum quenching distance has been reached during the opening of the breaker, preventing blasting of the arc before the switch contacts have reached their quenching distance.

4 Claims, 3 Drawing Figures

COMPRESS GAS CIRCUIT BREAKER

BACKGROUND OF THE INVENTION

This invention relates to circuit breakers in general and more particularly to an improved compressed gas circuit breaker.

Compressed gas circuit breakers with two contacts and a nozzle-like insulating body, which are arranged coaxially and are movable relative to each other in the direction of their axis are known. The insulating material body serves, along with pressure springs, as a stop for closing off the gas flow canal. At least one of the contacts, generally, is designed in the shape of a hollow cylinder with a nozzle-shaped entrance. The arc drawn in such puffer or two-pressure breakers when the contacts are opened is blasted essentially radially by the flow of quenching gas due to the nozzle shape of the insulating material body in conjunction with the hollow cylindrical contact.

In one known compressed gas circuit breaker with contacts movable in the axial direction and designed in nozzle-fashion, a valve which can be controlled by the onset of the gas flow toward the quenching gap, is provided in the gas stream. A piston, which compresses the gas in a space underneath the piston, is fastened to the movable contact. A nozzle-like body of insulating material, which surrounds the quenching gap, serves as a stop for closing off the gas flow canals. In the closed condition of the breaker, the canals are closed off by a ring through the force of pressure springs which are designed so that during an opening operation, the body of insulating material is lifted from the flow canals against the spring force at a predetermined pressure of the quenching gas, and releases the gas flow to the quenching gap. As the gas pressure increases steadily, the flow canals open accordingly. The damger of oscillations, the damping of which requires special measures, is therefore not precluded (German Offenlegunsschrift No. 2,336,684).

In another known compressed gas circuit breaker, the quenching gas flow sets in when the contacts have already travelled a predetermined part of their opening distance. The quenching chamber contains a movable switching pin and an annular fixed contact which is surrounded by a cylinder of insulating material. The blasting piston is provided with a follower piston which partially encloses the movable breaker contact, closes off the stationary cylinder of insulating material from the puffer piston in the closed condition of the breaker and protrudes from the stationary cylinder during the opening, and thereby releases the gas flow only when the movable contact has travelled at least one quarter of its total opening distance. The gas flow is substantially axial to the arc. The breaker is therefore suitable only for relatively small currents (Swiss Pat. No. 409,060).

SUMMARY OF THE INVENTION

It is an object of the present invention to improve the compressed gas circuit breakers of the type mentioned at the outset and, in particular, to increase their switching capacity by applying the known control of the gas flow as a function of the opening travel of the contacts.

According to the present invention, this problem is solved by providing means coupled to the relative motion of the contacts in such a manner that, during the opening of the compressed gas breaker, the body of the insulating material is moved to open the gas flow canals as soon as the minimum quenching distance of the contacts is reached. In the closed condition of the contacts, the body of insulating material closes off the opening of flow canals at the end of one of the contacts. As soon as the minimum quenching distance of the switch contacts is reached, the body of insulating material is lifted from the flow canals and the gas flow is thereby released.

In one embodiment of the compressed gas circuit breaker, of the present invention the body of insulating material is provided, for instance, with at least one pressure spring, the spring force of which becomes ineffective as soon as the minimum quenching distance of the contacts is reached.

In a special embodiment of the present invention, opening springs, preferably with substantially less spring force than the force of the pressure spring, are provided for the relative motion of the body of insulating material. The movable insulator body is then pressed onto the opening of the flow canal by the strong pressure spring against the force of the weaker opening springs and the pressure of the compression chamber.

In the closed condition of the circuit breaker, the body of insulating material is pressed by the pressure spring, against the force of the opening springs, against the electrode in such a manner that the gas flow canals are closed off. During the opening of the breaker, the gas flow canal remains closed, regardless of the pressure prevailing in the compression chamber, until the separating electrodes have reached the minimum quenching distance. Only then, does the gas flow toward the quenching gap and, thereby, the blasting of the arc, set in. The action of the pressure spring can be limited, for instance, by a stop, and the opening springs, aided by the pressure in the compression chamber, will then push the insulator body into the opening position during the further advance of the moved electrode. The opening springs then hold the insulator body in this desired blasting position up to the end of the interrupting process, independently of possible pressure fluctuations in the compression chamber caused by the arc.

For releasing the gas flow in dependence on the opening travel of the contacts, a latching arrangement, for instance, may further be provided, which, when the minimum quenching distance is reached, is unlatched, for instance, via a switching cam, so that then the opening springs can push the movable insulator body into the blasting position.

The spring force of the pressure springs can preferably be chosen larger than would be necessary for closing off the gas flow canal. The energy content of the pressure spring is thereby increased above the value required for pressing on the body of insulating material. Thereby, part of the total driving energy, which is required for opening the breaker, is stored in the spring and is used for the initial acceleration of the movable contact, whereby the minimum quenching distance can be reached correspondingly faster. This design can be provided particularly in so-called "two-cycle" breakers.

With the travel distance dependent control provided in two-pressure breakers, the quenching medium flow, which is conducted from the high pressure space to the quenching gap via a valve in a manner known per se, can then be inhibited by the displacement device until the minimum quenching distance is reached and only then released.

In a further embodiment of the compressed gas circuit breaker of the present invention, the pressure spring for keeping the flow canal closed can also be arranged inside the fixed contact. A driving element for the insulator body can then, for instance, run in slots, the length of which determine the stroke of the spring.

DETAILED DESCRIPTION OF THE INVENTION

Figure 1:
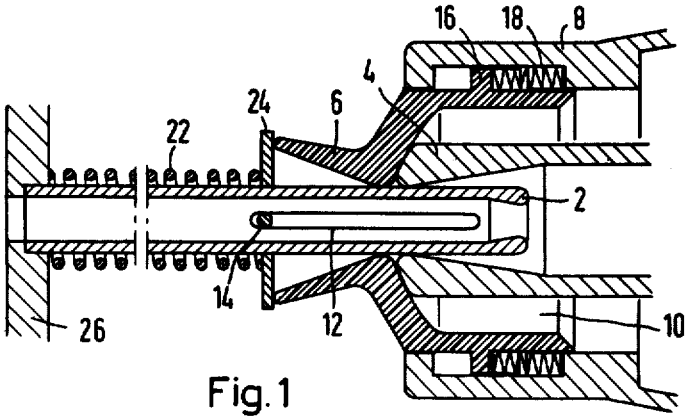
FIG. 1 is a cross-sectional view of one embodiment of a compressed gas breaker according to the present invention having a pressure spring externally surrounding one of the contacts for maintaining the insulating body in a position where it closes off the gas flow canal, this embodiment being shown in the closed position.

In the embodiment of a compressed gas circuit breaker according to FIG. 1, of which only the contact system with the control of the gas supply is shown, contacts 2 and 4 movable relative to each other are shown along with a nozzle-shaped body 6 of insulating material. The insulator body 6 is supported for movement relative to a blasting ("puffer") piston 8, of which only part is shown in the figure, in the direction of the axis of the contacts 2 and 4, and closes off an annular flow canal 10 for quenching gas at the mouth of the contact 4. With motion of the puffer piston 8 quenching gas is supplied from a tank, which is likewise not shown in the figure.

A pressure spring 22, is placed on the contact 2. The spring travel of spring 22 is limited by an extension 24 which is slidingly supported on the contact in the axial direction and is firmly connected to the spring. For this purpose, the contact 2 is provided, for instance, with slots 12, through which a pin 14 is brought. The contact 4 is connected to a drive mechanism not shown in the figure.

If, for instance, the contact 4 is moved, from the closed position of the switch, to the right, the flow canal 10 initially is kept closed by the insulator body 6 under the spring force of the pressure spring 22 acting on it, until the pin 14 reaches the right-hand end of the slot 12 at which time the extension 24 reaches its right-hand end position and limits the spring travel of the pressure spring 22. In the course of the further motion of the electrode 4, the insulator body 6 is moved relatively to the left under the action of the opening springs 18 and thereby releases the gas flow from the flow canal 10 to the quenching gap within the nozzle mouth of the insulator body 6. Up until this instant, therefore, the arc drawn in the quenching gap, not specifically designated, after the contacts 2 and 4 are opened, burns within the constriction of the insulator body 6 without being blasted by the quenching gas and its energy consumption is therefore correspondingly small.

Figure 2:
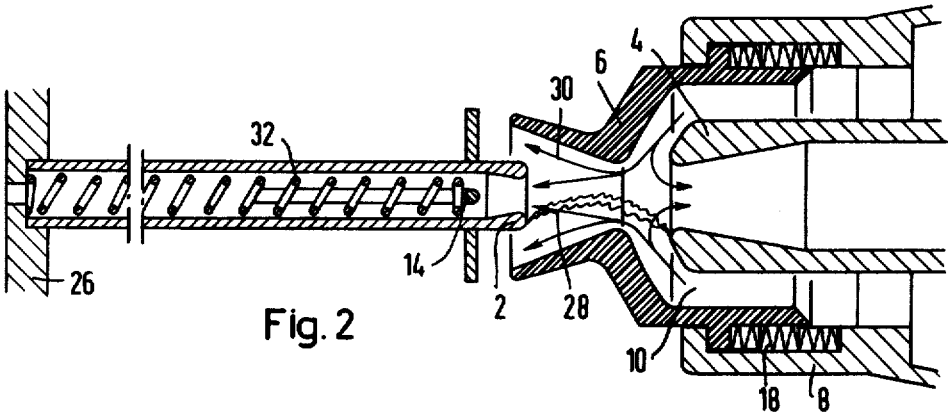
FIG. 2 is a similar view of an embodiment in which the spring is installed inside one of the contacts, this embodiment being shown in the opened position.

In the open condition of the contacts 2 and 4 according to FIG. 2, the blasting of an arc 28 has set in, after the insulator body 6 had released the flow canal 10 under the action of the opening springs 18, as is indicated in the figure by the reference numberal 30.

In this embodiment of the contact system, a pressure spring 32 is arranged inside the hollow cylindrical contact 2. The spring travel of the pressure spring 32 is determined in this case by the pin 14 and the right-hand end of the slot in contact 2.

Figure 3:
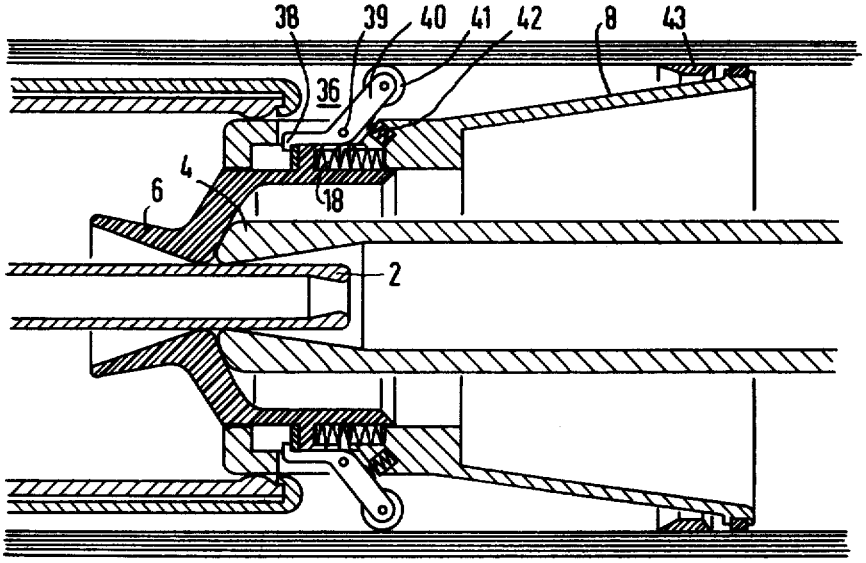
FIG. 3 is a similar view of a compressed gas circuit breaker, in which the insulator body is held, in the closed breaker condition, by a latch system.

In the embodiment of the contact system according to FIG. 3, the motion of the insulator body 6 is released by a latching system 36 which may contain, for instance, a pawl 38 pivoted about a shaft 39. The pawl 38 is connected to a lever 40, at the end of which a wheel 41 is mounted. With the breaker closed, the pawl 38 is held by a pawl spring 42 in the position shown. At the inside wall of the casing for puffer piston 8, dogs 43 are provided, which release the pawl 38 via the wheel 41 when the puffer piston 8 moves to the right. As soon as the mouths of the contacts 2 and 4 reach the minimum quenching distance, the latch is released via the dogs 43 and the opening springs 18 push the insulator body 6 into the quenching position.

The length of the fixed contact 2, over which the latter extends into the movable contact 4, need no longer be designed, in the embodiment of the circuit breaker according to the present invention, in accordance with the desired pre-compression ratio. This length can therefore be designed exclusively so that, after the current is commutated to the contacts 2 and 4, sufficient spacing of the continuing current contact system, not shown in the illustrated embodiment, is obtained. This spacing ensures that the arc generated is always drawn in the central quenching contact system. In practice, this usually means a shortening of the electrode and therefore has a beneficial effect in view of the total interrupting time of such breakers. The desired pre-compression ratio is obtained via a suitable choice of the total length of the compression chamber. It can further be adjusted by means of overrun valves.

It is claimed:

1. A compressed gas circuit breaker comprising:
   (a) first and second contacts disposed coaxially, and movable in their axial direction with respect to each other;
   (b) a nozzle-like insulator body supported for movement with respect to one of said contacts between a first position where it forms, with said one contact, a flow canal for directing compressed gas to the area of an arc which is drawn between said contacts and a second position where it abuts against said one contact to close off said flow canal;
   (c) means for holding said insulating body in said second position; and
   (d) means responsive to relative movement of said contacts for releasing said means for holding during separation of said contacts always as soon as the minimum quenching distance of said contacts is reached whereby said insulating body may move to said first position to open said flow canal to quench an arc drawn between said contacts.

2. The circuit breaker according to claim 1 and further including opening springs disposed so as to tend to move said insulator body to said first position, whereby, upon operation of said means for releasing, movement of said insulating body to said first position will be facilitated.

3. The circuit breaker according to claim 1 or 2 wherein said means for holding comprise a spring adapted to act against said body to hold it in said second position and said means for releasing comprise a stop arranged to render said spring ineffective when said minimum quenching distance is reached.

4. The circuit breaker according to claim 1 or 2 wherein said means for holding comprise a latching system for latching said insulating body in said second position and said means for releasing comprise means to release said latching system when said minimum quenching distance is reached.

* * * * *